US005370038A

United States Patent [19]

Poppe et al.

[11] Patent Number: 5,370,038

[45] Date of Patent: Dec. 6, 1994

[54] REGENERATION CIRCUIT FOR A HYDRAULIC SYSTEM

[75] Inventors: Kenneth E. Poppe, Peoria; John P. Mitchell, Downers Grove, both of Ill.

[73] Assignee: Caterpillar Inc., Peoria, Ill.

[21] Appl. No.: 993,758

[22] Filed: Dec. 21, 1992

[51] Int. Cl.[5] ..... F15B 11/08; F15B 13/04

[52] U.S. Cl. ..... 91/436; 91/415; 91/448; 91/461; 60/459

[58] Field of Search ..... 91/415, 436, 444, 445, 91/446, 447, 448, 442, 420, 421, 459, 461; 60/459, 468

[56] References Cited

U.S. PATENT DOCUMENTS

| | | | |
|---|---|---|---|
| 3,438,307 | 4/1969 | Ahlenius | 91/436 |
| 4,282,898 | 8/1981 | Harmon et al. | 91/446 X |
| 4,321,855 | 3/1982 | Bacquie et al. | 91/436 |
| 4,397,221 | 8/1983 | Friesen et al. | 91/436 X |
| 5,226,348 | 7/1993 | Dezelan et al. | 91/448 |

FOREIGN PATENT DOCUMENTS

| | | | |
|---|---|---|---|
| 2538466 | 6/1984 | France | 91/420 |
| 2346622 | 4/1975 | Germany | 91/448 |
| 0885644 | 11/1981 | U.S.S.R. | 91/420 |
| 0985473 | 12/1982 | U.S.S.R. | 91/420 |
| 1455069 | 1/1989 | U.S.S.R. | 91/420 |

*Primary Examiner*—Edward K. Look
*Assistant Examiner*—Hoang Nguyen
*Attorney, Agent, or Firm*—John W. Grant

[57] ABSTRACT

Regeneration valves are useful in directing fluid expelled from a contracting chamber of a hydraulic actuator to its expanding chamber to increase the actuation speed of the actuator. The present remotely controlled regeneration circuit improves the controllability of the regeneration valve by positioning the regeneration valve between the pump and the control valve so that the fluid expelled from the contracting chamber and combined with the pump flow to the expanding chamber passes through and is controlled by the control valve. The regeneration valve is moved to its regeneration position by pressurized fluid from a solenoid valve which can be selectively energized by the operator manually closing a switch mounted to a control lever.

9 Claims, 1 Drawing Sheet

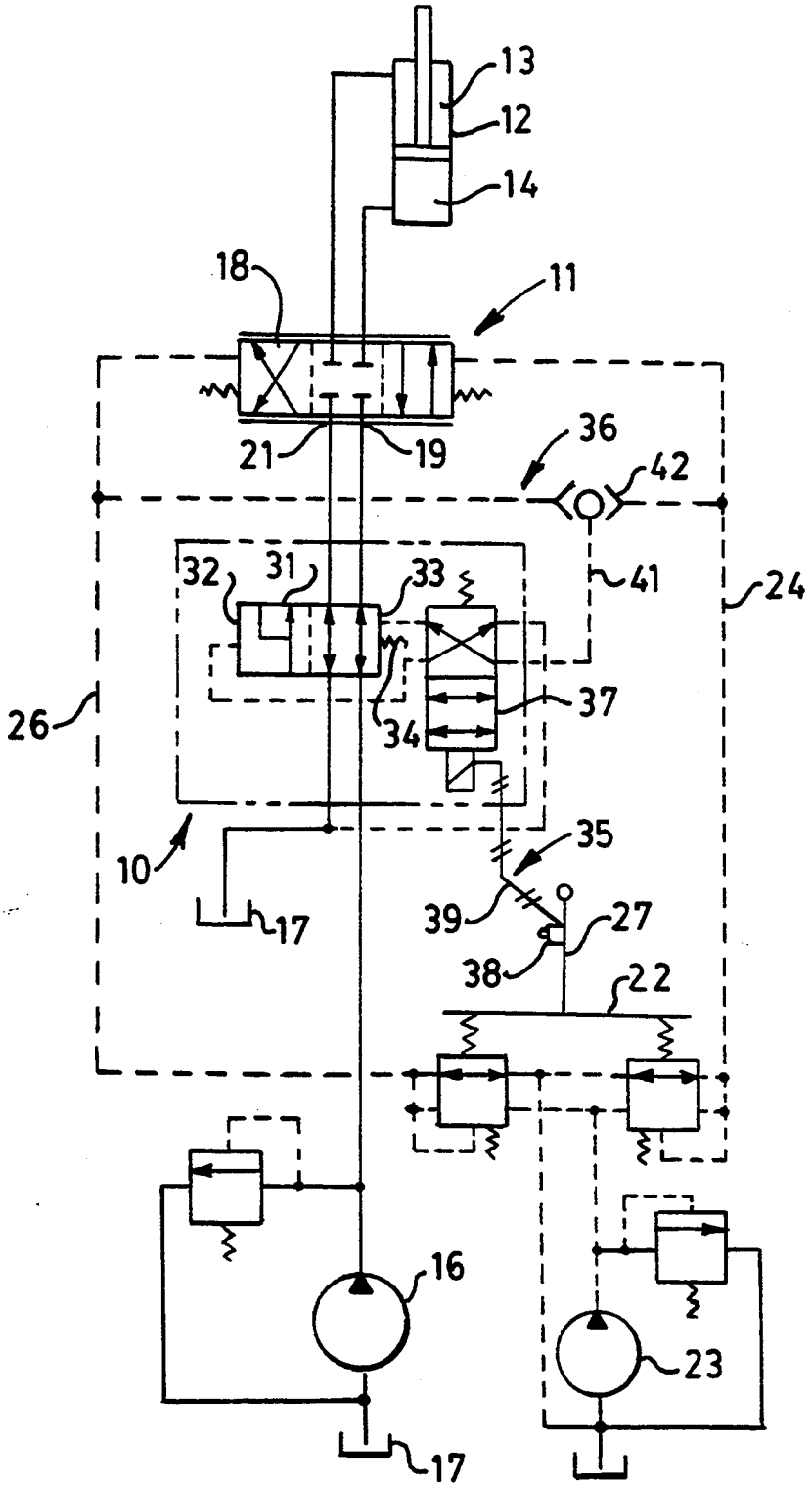
13
12
14
18
11
21
19
36
42
41
24
32
31
33
37
34
26
10
35
17
39
27
38
22
16
23
17

REGENERATION CIRCUIT FOR A HYDRAULIC SYSTEM

TECHNICAL FIELD

This invention relates generally to a hydraulic system and more specifically to a remotely controlled regeneration circuit for a hydraulic system.

BACKGROUND ART

Regeneration valves that direct some of the fluid exhausted from the contracting chamber of a double-acting actuator to the expanding chamber thereof to provide an extension speed greater than that provided by pump flow only are well known. One common type of regeneration valve is disposed between the main directional control valve and the actuator to provide a quick drop feature for actuators driven in one direction by gravity loads. One of the problems associated with having the regeneration valve between the main control valve and the actuator is that the operator has little or no control over the amount of regenerated fluid recirculated from the contracting chamber to the expanding chamber. Moreover, such regeneration valves are frequently triggered to their regeneration position automatically when the flow rate of the fluid expelled from the contracting chamber exceeds a predetermined flow rate such that regeneration takes place only under certain operating conditions.

Thus, it would be desirable to have a regeneration valve that can be selectively moved to the regeneration position at the discretion of the operator. It would also be desirable to have a regeneration circuit in which the operator retains control over the amount of fluid directed to the expanding chamber of the actuator for controlling the speed of the actuator.

The present invention is directed to overcoming one or more of the problems as set forth above.

DISCLOSURE OF THE INVENTION

In one aspect of the present invention, a remotely controlled regeneration circuit is provided for a hydraulic system having a pump, a tank, a double acting hydraulic actuator having first and second actuating chambers, and a control valve connected to the first and second actuating chambers and having an inlet port and an outlet port. The regeneration circuit comprises a regeneration valve connected to the pump, the tank and to the inlet and outlet ports of the control valve and is movable between a non-regeneration position communicating the pump with the inlet port and the outlet port with the tank and a regeneration position communicating both the pump and the outlet port with the inlet port while blocking flow to the tank. A means is provided for selectively moving the regeneration valve to the regeneration position in response to receiving a control signal.

BRIEF DESCRIPTION OF THE DRAWINGS

The sole FIGURE is a schematic illustration of an embodiment of the present invention.

BEST MODE FOR CARRYING OUT THE INVENTION

A remotely controlled regeneration circuit 10 is shown incorporated within a hydraulic system 11 for controlling the extension and retraction of a double acting hydraulic actuator 12 having a rod end actuating chamber 13 and a head end actuating chamber 14. The hydraulic system 11 includes a hydraulic pump 16, a tank 17, and a pilot operated directional control valve 18 having an inlet port 19 and an outlet port 21. A pilot control valve 22 is connected to a pilot pump 23 and to opposite ends of the directional control valve 18 through pilot lines 24,26. A control lever 27 is suitably connected to the pilot valve 22.

The regeneration circuit 10 includes a regeneration valve 31 disposed between and connected to the pump 16 and the inlet and outlet ports 19,21 The regeneration valve 31 is also connected to the tank 17 and has opposite ends 32,33 and a spring 34 resiliently urging the regeneration valve leftwardly to a non-regeneration position shown. At the non-regeneration position, the pump 16 communicates with the inlet port 19 and the outlet port 21 communicates with the tank 17. The regeneration valve 31 is movable rightwardly to a second or regeneration position at which both the outlet port 21 and the pump 16 communicate with the inlet port 19 and are blocked from the tank 17. The regeneration valve 31 is pilot operated and is moved to its regeneration position when a hydraulic signal is directed to the end 32 opposing the bias of the spring 34.

A means 36 is provided for selectively moving the regeneration valve 31 to the regeneration position in response to receiving a control signal from a remote location. The means 36 includes a source of pressurized pilot fluid and a two-position solenoid valve 37 connected to the source of pilot fluid and the end 32 of the regeneration valve 31. The solenoid valve is also connected to the tank 17 and to the end 33 of the regeneration valve. The means 36 also includes an electrical switch 38 mounted on the control lever 27 and electrically connected to the solenoid valve 37 through a lead line 39.

INDUSTRIAL APPLICABILITY

Retraction of the hydraulic actuator 12 is initiated by the operator moving the control lever 27 counterclockwise to controllably direct pressurized fluid from the pilot control valve 22 through the pilot line 26 moving the control valve 18 rightwardly. With the regeneration valve 31 in the position shown, rightward movement of the control valve 18 directs fluid from the pump 16 through the regeneration valve 31 and the control valve 18 to the rod end chamber 13. The fluid expelled from the head end chamber 14 is directed through the control valve 18 and the regeneration valve 31 to the tank 17.

Extension of the actuator 12 is initiated by the operator moving the control lever 27 clockwise to controllably direct pressurized pilot fluid from the pilot valve 22 through the pilot line 24 to move the control valve 18 leftwardly. With the regeneration valve 31 in the position shown, leftward movement of the control valve 18 communicates fluid from the pump 16 to the rod end chamber 14 of the actuator 12. The fluid expelled from the rod end chamber passes through the control valve 18 and the regeneration valve 31 to the tank 17.

To obtain regeneration when the control valve 18 is moved leftwardly by pilot pressure in the pilot line 24, the operator manually closes the switch 38 directing an electrical signal to energize the solenoid valve 37 moving it upwardly to its second position. At the second position, a hydraulic signal from the pilot line 24 is directed to the end 32 of the regeneration valve 31 moving it rightwardly against the force of the spring 34.

The regeneration valve 31 at its rightward regeneration position combines the fluid expelled from the rod end chamber 13 with the fluid from the pump 16 and directs the combined flow to the head end chamber 14. Since the combined fluid passes through the control valve 18, the control valve can still be used to control the extension speed of the actuator.

In view of the above, it is readily apparent that the structure of the present invention provides an improved regeneration circuit which can be remotely controlled by the operator to selectively obtain faster extension speed of the actuator while still maintaining control of the actuation speed. This is accomplished by positioning a regeneration valve between the pump and the control valve with actuation of the regeneration valve being controlled by a solenoid valve which in turn is energized by a switch on the control lever. Thus, when the operator desires to have the actuator extend at a rate faster than can be provided by pump flow only, he can selectively move the regeneration valve to the regeneration position so that the fluid expelled from the rod end chamber is directed to the head end chamber along with the pump flow.

Other aspects, objects and advantages of this invention can be obtained from a study of the drawings, the disclosure and the appended claims.

We claim:

1. A remotely controlled regeneration circuit for a hydraulic system having a pump, a tank, a double-acting actuator having rod end and head end actuating chambers, and a control valve connected to the rod and head end chambers and having an inlet port and an outlet port, the control valve having an operative position at which the inlet port communicates with the head end chamber and the rod end chamber communicates with the outlet port, comprising:

a regeneration valve connected to the pump and the tank and to the inlet and outlet ports of the control valve, the regeneration valve having a non-regeneration position communicating the pump with the inlet port and the outlet port with the tank and a regeneration position communicating both the pump and the outlet port with the inlet port while blocking flow to the tank; and means for selectively moving the regeneration valve from the non-regeneration position to the regeneration position in response to receiving a control signal so that fluid exhausted from the rod end chamber when the control valve is in the operative position is combined with the fluid from the pump passing through the control valve to the head end chamber.

2. The remotely controlled regeneration circuit of claim 1 wherein the regeneration valve has a spring resiliently urging the regeneration valve to the non-regeneration position.

3. The remotely controlled regeneration circuit of claim 2 wherein the regeneration valve is pilot operated and is moved to its regeneration position when a hydraulic signal is directed to one of its ends opposing the bias of the spring.

4. The remotely controlled regeneration circuit of claim 3 wherein the selective moving means includes a source of pilot fluid and a solenoid valve disposed between the source of pilot fluid and the one end of the regeneration valve and having a first position blocking the source of pilot fluid from the one end and a second position communicating the source of pilot fluid with the one end.

5. The remotely controlled regeneration circuit of claim 4 wherein the solenoid valve is moved to the second position in response to receiving an electrical signal.

6. The remotely controlled regeneration circuit of claim 5 wherein the control valve is pilot operated and including a pilot pump, a pilot control valve connected to the pilot pump, and a pair of pilot lines connecting the pilot control valve to the ends of the control valve.

7. The remotely controlled regeneration circuit of claim 6 wherein the source of pilot fluid is one of the pilot lines.

8. The remotely controlled regeneration circuit of claim 7 wherein the pilot valve includes a control lever and the selective moving means includes an electrical switch mounted on the control lever and electrically connected to the solenoid valve.

9. A remotely controlled regeneration circuit for a hydraulic system having a pump, a tank, and a double acting actuator having rod end and head end actuating chambers, comprising:

a pilot operated control valve connected to the rod and head end chambers and having an inlet port and an outlet port;

a regeneration valve connected to the pump and to the tank and to the inlet and outlet ports of the control valve, the regeneration valve having a non-regeneration position communicating the pump with the inlet port and the outlet port with the tank and a regeneration position communicating both the pump and the outlet port with the inlet port while blocking flow to the tank;

a pilot control valve having a control lever;

a pair of pilot lines connecting the pilot control valve to the ends of the control valve; and means for selectively moving the regeneration valve to the regeneration position in response to receiving a control signal so that fluid exhausted from the rod end cylinder when the control valve is in the operative position is combined with the fluid from the pump passing through the control valve to the head end chamber, the means including an electrical switch mounted on the control lever to provide the control signal to the regeneration valve.

* * * * *